US005489819A

United States Patent [19]

Sakai et al.

[11] Patent Number: 5,489,819

[45] Date of Patent: Feb. 6, 1996

[54] METHOD OF OPERATING A METALLIC VAPOR DISCHARGE LAMP

[75] Inventors: Motohiro Sakai; Kazuhiro Goto, both of Himeji, Japan

[73] Assignee: Ushiodenki Kabushiki Kaisha, Tokyo, Japan

[21] Appl. No.: 214,326

[22] Filed: Mar. 17, 1994

[30] Foreign Application Priority Data

Mar. 17, 1993 [JP] Japan ..... 5-081106

[51] Int. Cl.[6] ..... H01J 7/44

[52] U.S. Cl. ..... 315/49; 315/50; 313/638; 313/639; 313/642; 250/504 R

[58] Field of Search ..... 315/49, 50, 246, 315/248; 313/638, 639, 642; 250/504

[56] References Cited

U.S. PATENT DOCUMENTS

| | | | |
|---|---|---|---|
| 2,625,670 | 1/1953 | Embshoff | 315/50 |
| 2,724,790 | 11/1955 | Embshoff et al. | 315/49 |
| 4,112,335 | 9/1978 | Gonser | 315/241 R |
| 4,143,278 | 3/1979 | Koch, II | 250/527 |
| 4,149,086 | 4/1979 | Nath | 250/504 |
| 4,155,026 | 5/1979 | Dobrusskin et al. | 313/229 |
| 4,591,724 | 5/1986 | Fuse et al. | 250/492.1 |
| 4,769,576 | 9/1988 | Ohyama et al. | 313/638 |
| 5,107,178 | 4/1992 | Ohyama et al. | 313/639 |

FOREIGN PATENT DOCUMENTS

| | | |
|---|---|---|
| 0444591 | 9/1991 | European Pat. Off. . |
| 54-58979 | 5/1979 | Japan . |

*Primary Examiner*—Robert J. Pascal
*Assistant Examiner*—Haissa Philogene
*Attorney, Agent, or Firm*—Keck, Mahin & Cate

[57] ABSTRACT

The method of conducting a lighting operation of a metallic vapour discharge lamp, to maintain a suitable arc tube temperature, even if the lamp is operated at an input power higher than 160 W/cm of lighting length. A metallic vapour discharge lamp, in which mercury, rare gas, iron and halogen are encapsulated wherein an arc tube is used and which is operated with an internal pressure of 0.5 to 10 psi, an input power of higher than 160 W/cm of lighting length and within a heater having an air injection cooling system. The lamp characteristics are $D \leqq 28$ and simultaneously $P/D \leqq 14$, where the arc tube external diameter is designated D (mm) and the input power/cm of lighting length is designated P (W/m).

2 Claims, 5 Drawing Sheets

METHOD OF OPERATING A METALLIC VAPOR DISCHARGE LAMP

BACKGROUND OF THE INVENTION

1. Field of the Invention

The invention relates to method of controlling a metallic vapour discharge lamp, which is used as an ultraviolet light source.

2. Background of the Disclosure

It is generally known in technical fields, such as, photochemical reactions, and the curing of paints and inks or the like, to use ultraviolet rays in a wavelength range of 250 to 400 nm. The term "paint" is also intended to cover the more general term "lacquer".

Normally a metallic vapour discharge lamp is used as such an ultraviolet radiation source. For a more optimized use with respect to the above-described purposes, use is made of a metallic vapour discharge lamp in which is encapsulated iron, which has a plurality of line spectra in a wavelength range of 350 to 400 nm.

However, if such a metallic vapour discharge lamp remains in operation for a long time, due to the adhesion of the iron to the inner wall of the arc tube a thin film is formed. The problem then arises that the quantity of iron contributing to the luminescing action decreases, and simultaneously the thin film prevents the passage of the ultraviolet rays. Consequently the intensity of the ultraviolet rays is significantly reduced.

In order to solve the above problem a measure is performed, in which e.g. at least one of the metals lead, tin, thallium, cadmium, magnesium, bismuth or the like is selected or metal halide is added and in which simultaneously the arc tube temperature is regulated to 550° to 800° C. As is known, this measure prevents the formation of the thin iron film over a long period of time.

However, if the arc tube temperature is below 550° C., the encapsulated metal halide condenses in a low temperature part within the arc tube and as a result a desired emission cannot be obtained. Also, if the are tube temperature rises above 800° C., it is not possible to adequately perform a halogen cycle within the arc tube, which leads to an adhesion of a thin film of the metals, particularly iron, within the are tube. It is therefore necessary to keep the arc tube temperature constant in a range 550° to 800° C.

Such a metallic vapour discharge lamp has been conventionally used in such a way that it is operated with an input power of equal to or lower than 160 W/cm lighting length and is simultaneously cooled by the exhausting or blowing out of air, as shown in FIG. 2.

However, of late, there has been a need for a stronger intensity or output of the ultraviolet rays. In order to cover this requirement it is necessary to operate the lamp with an input path of greater than 160 W/cm lighting length. However, in this case it is also necessary to increase the cooling capacity of the lamp and it is found that the arc tube temperature cannot be maintained in the range 550° to 800° C. using the techniques of the prior art.

SUMMARY OF THE INVENTION

The object of the invention, is to provide a method for controlling the lighting operation of a metallic vapour discharge lamp, in a way to maintain a suitable arc tube temperature, even if the lamp is operated with an input power higher than 160 W/cm lighting length.

According to the invention this object is achieved in that in the case of a metallic vapour discharge lamp, in which within an arc tube are encapsulated at least mercury, rare gas, iron and halogen, and which is operated with an input power higher than 160 W/cm and by utilizing air injecting cooling, and wherein $D \leqq 28$ and simultaneously $P/D \leqq 14$, where the external diameter of the arc tube is designated D(mm) and the input power/cm of lighting length as P (W/cm).

As a result of the relationship by which the external diameter of the arc tube is within a given range, which is determined by an input power/era of lighting length, the arc tube temperature can be kept within a suitable range, even if the lamp is operated with an input power higher than 160 W/cm of lighting length. Thus, the formation of the thin iron film can be prevented, even if the lamp remains in operation for a long time.

BRIEF DESCRIPTION OF THE DRAWINGS

The invention is described in greater detail hereinafter relative to the attached drawings, wherein show.

DETAILED DESCRIPTION

Figure 1:
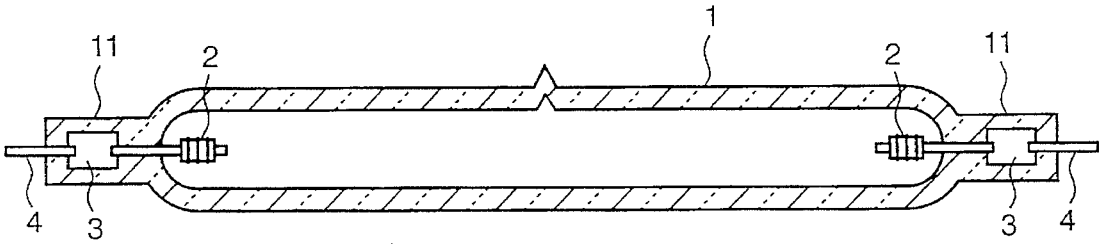
FIG. 1 A diagrammatic representation of the metallic vapour discharge lamp according to the invention.

FIG. 1 diagrammatically shows an essential arrangement of the metallic vapour discharge lamp according to the invention. Reference numeral 1 stands for a quartz glass arc tube 1 having an external diameter of e.g. 26 mm used in the above-described metallic vapour discharge lamp and which hereinafter is referred to as "lamp". Within the arc tube 1 a pair of electrodes 2 are positioned facing one another at both ends in the axial direction of the tube. On the two ends of the arc tube 1 is provided a seal portion 11, in which is hermetically enclosed a molybdenum foil 3. A lead wire 4 and the electrode 2 are electrically connected by means of said metal foil 3.

Figure 2:
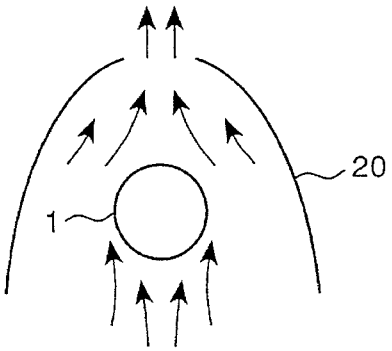
Fig. 2 (PRIOR ART)
FIG. 2 A diagrammatic representation of a heater with an air exhaust cooling system.

The above-described lamp was operated using the air blow-out or exhaust cooling system shown in FIG. 2. By varying an input power/cm of lighting length, in each case a maximum temperature of the arc tube is measured at each input value, whilst cooling the lamp in such a way that the minimum temperature of the arc tube is 550° C.

As an increase in the cooling capacity under the particular conditions not only leads to a lowering of the maximum temperature of the arc tube, but also to a lowering of the minimum temperature and consequently a lowering of the minimum temperature of the arc tube beyond the appropriate range of 550° C., the maximum temperature was measured, by placing the minimum temperature of the arc tube at 550° C. in all cases. The measurement result is shown in FIG. 4.

FIG. 2 does not provide a complete representation of a heater. Cooling air is sucked through an opening of a reflecting mirror 20 taking up one entire side of the arc tube 1 and said air is blown out of an opening located in an upper part of said mirror 20.

Figure 4:
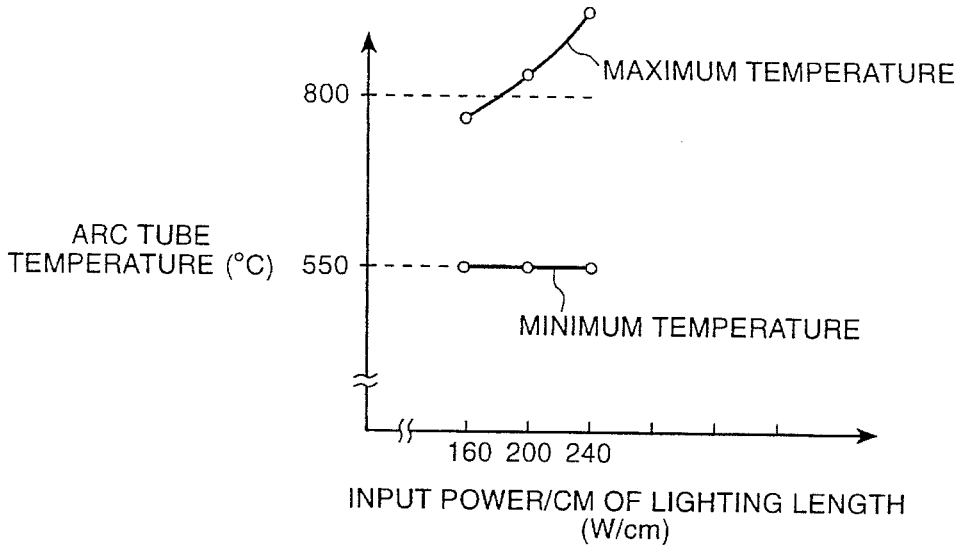
FIG. 4 A diagrammatic representation showing the relationship between an input power/cm of lighting length and an arc tube temperature, using an air exhaust cooling system.

As can be seen in FIG. 4, the temperature of the arc tube cannot be maintained within the appropriate temperature range of 550° to 800° C., if the input power/cm of lighting length rises above 160 W/cm.

The term "lighting length" is understood to mean the distance between the electrodes and which is e.g. 250 min. Therefore an input power/cm can be calculated on the basis of a relationship between an input power used for the lamp and the lighting length. An internal pressure during a lighting operation is at 0.5 to 10.0 psi.

Figure 3:
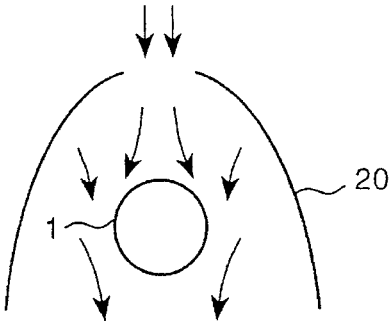
FIG. 3 A diagrammatic representation of a heater with an air injection cooling system.

A lamp identical to the above-described lamp was then operated using the air blow-in or injection cooling system shown in FIG. 3 and an input power/cm of lighting length higher than 160 W and the maximum arc tube temperature was measured, whilst the minimum arc tube temperature was regulated to 550° C. The measurement result is shown in FIG. 5.

FIG. 3 does not provide a complete representation of a heater. Using an opening located in an upper part of a reflecting mirror 20 or positioned within the latter, air is blown into the lamp, which is therefore cooled.

Figure 5:
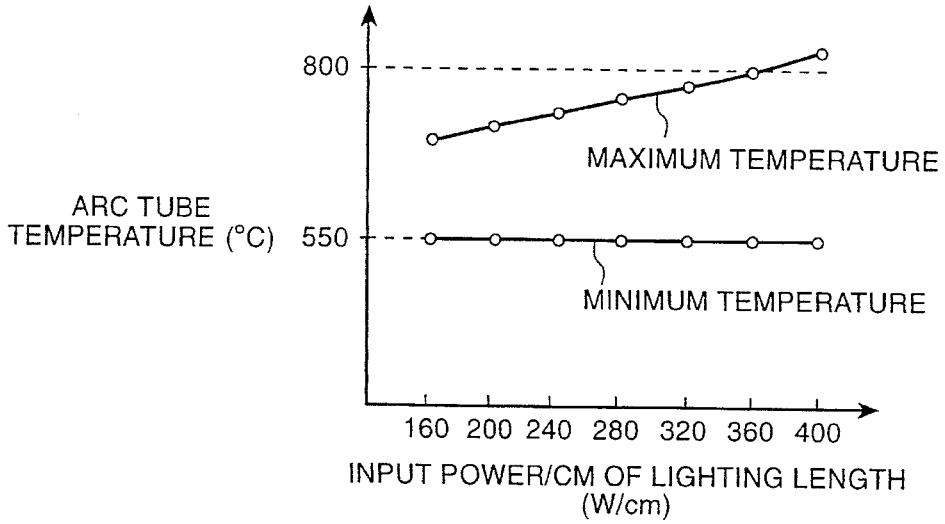
FIG. 5 A diagrammatic representation showing the relationship between an input power/cm of lighting length and an arc tube temperature using an air injection cooling system.

FIG. 5 shows that with an input power/cm of lighting length of up to 360 W, when using the air injection cooling system the arc tube temperature is in the suitable temperature range of 550° to 800° C.

Tests were then carried out, during which in the case of a lighting operation of a lamp using the air injection cooling system, the arc tube temperature was measured with a view to obtaining a relationship between an input power/cm of lighting length and an external diameter of the arc tube.

The maximum arc tube temperature was measured on varying the input power/cm of lighting length to 160 W, 200 W, 240 W, 280 W, 320 W, 360 W and 400 W, modifying arc tube external diameter in accordance with the particular input value and cooling the lamp in such a way that the minimum arc tube temperature is at 550° C.

For this purpose use was made of 9 lamps having arc tube external diameters of 14 mm, 16 mm, 18 mm, 20 mm, 22 mm, 24 mm, 26 mm, 28 mm and 30 mm, whilst all the remaining conditions, apart from the external diameters remained the same. The results are given in FIGS. 6 to 12.

Figure 6:
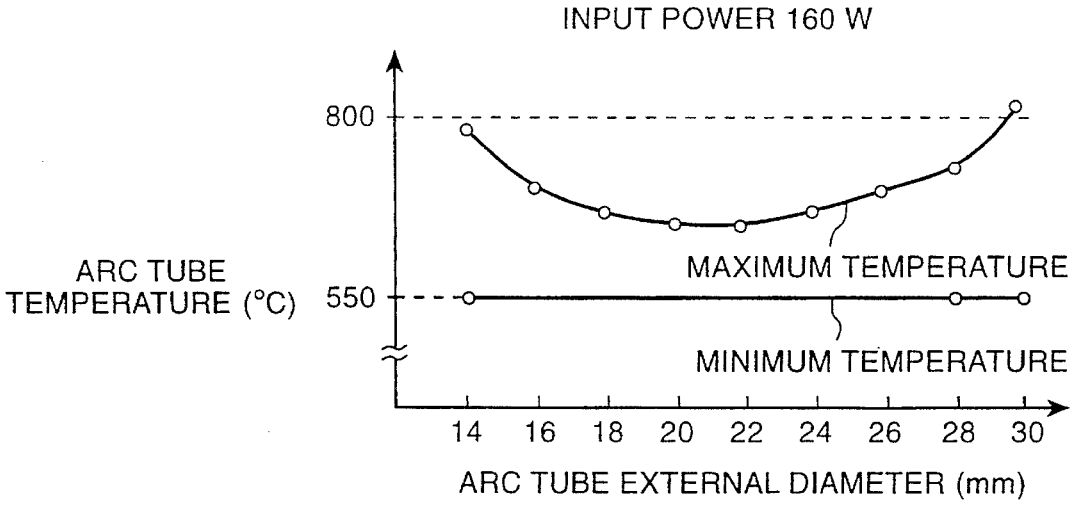
FIG. 6 A diagrammatic representation showing the relationship between an arc tube external diameter and an arc tube temperature using an input power of 160 W/cm of lighting length.

FIG. 6 shows the measured result using an input power/cm of lighting length of 160 W. In this case at arc tube external diameters of 14 mm (D=14, P/D=11.4) to 28 mm (D=28. P/D=5.7), the maximum arc tube temperature was reduced to equal to or lower than 800° C., whilst the minimum arc tube temperature was maintained at 550° C. However, if the arc tube external diameter was 30 mm (D= 30, P/D=5.3), the maximum arc tube temperature rose to above 800° C., whilst maintaining the minimum arc tube temperature of 550° C.

Figure 7:
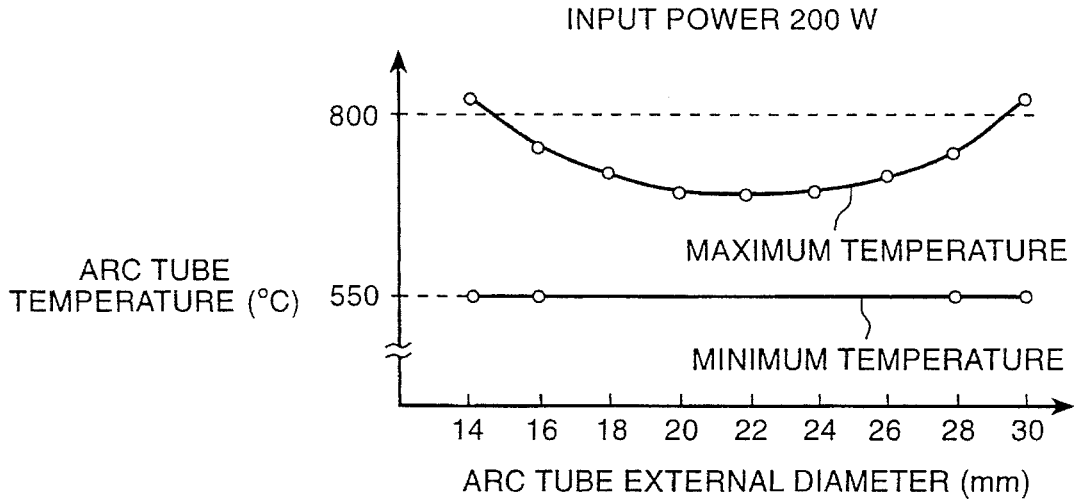
FIG. 7 A diagrammatic representation showing the relationship between an arc tube external diameter and an arc tube temperature using an input power of 200 W/cm of lighting length.

FIG. 7 shows the measurement result using an input power/cm of lighting length of 200 W/cm. In this case, with arc tube external diameters of 16 mm (D=16, P/D= 12.5) to 28 mm (D=28. P/D=7.1), the maximum arc tube temperature was reduced to equal to or lower than 800° C., whilst the arc tube minimum temperature was maintained at 550° C. However, if the arc tube external diameter is 14 mm (D= 14, P/D=14.3), the arc tube maximum temperature rose to above 800° C. Moreover, with an arc tube external diameter of 30 mm (D=30, P/D=6.7), the maximum arc tube temperature rose to above 800° C., on maintaining the arc tube minimum temperature at 550° C.

Figure 8:
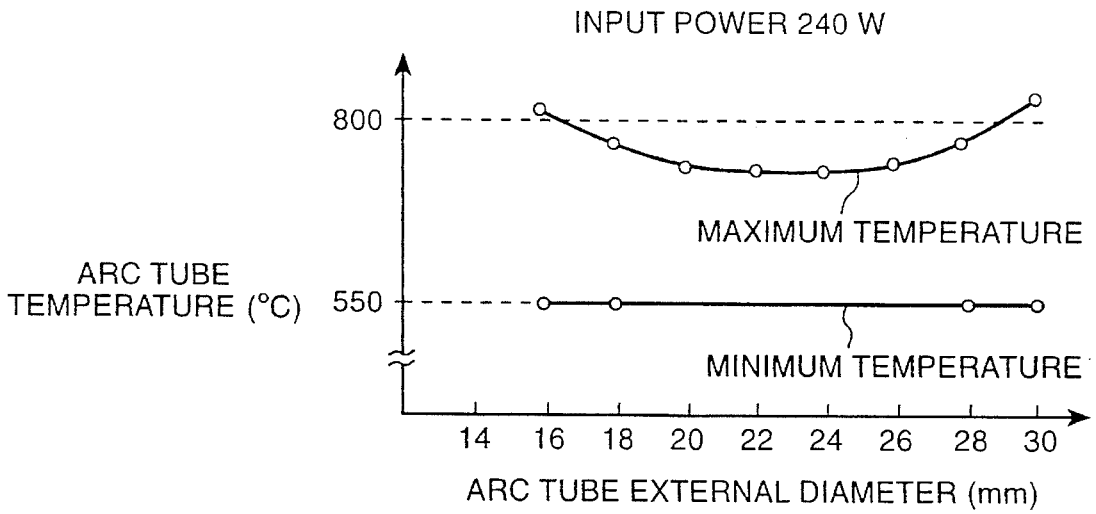
FIG. 8 A diagrammatic representation showing the relationship between an arc tube external diameter and an arc tube temperature using an input power of 240 W/cm of lighting length.

FIG. 8 shows the measured result using an input power/cm of lighting length of 240 W. In this case, with arc tube external diameters of 18 mm (D=18, P/D=13.3) to 28 mm (D=28. P/D=8.6), the maximum arc tube temperature was reduced to equal to or lower than 800° C., whilst maintaining the minimum arc tube temperature of 550° C. However, if the arc tube external diameter is 14 mm (D=14, P/D= 17.1) and 16 mm (D=16, P/D=15.0), the maximum arc tube temperature rose to above 800° C. In addition, with an arc tube external diameter of 30 mm (D=30, P/D= 8.0), the maximum arc tube temperature rose to above 800° C., whilst maintaining the arc tube minimum temperature of 550° C.

Figure 9:
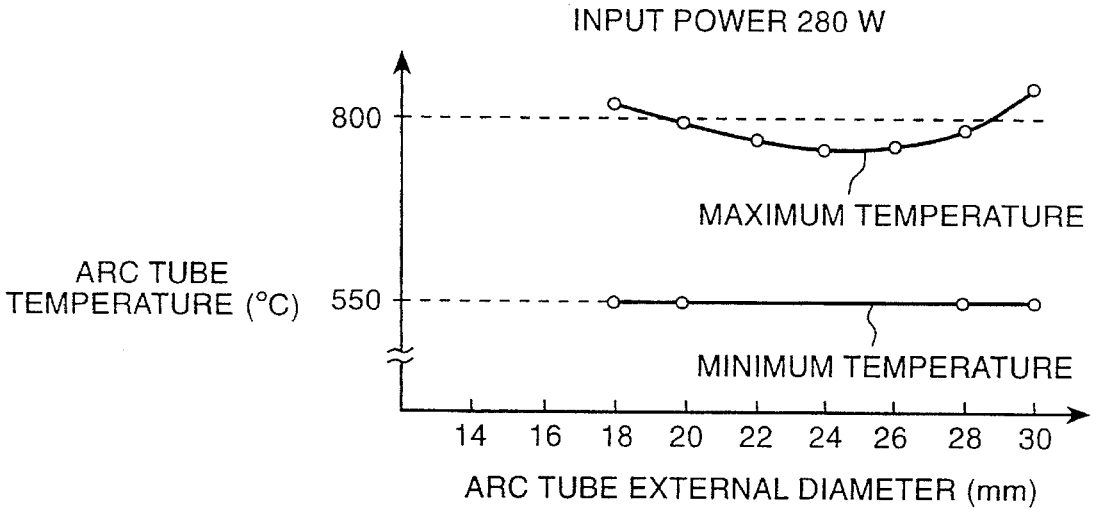
FIG. 9 A diagrammatic representation showing the relationship between an arc tube external diameter and an arc tube temperature using an input power of 280 W/cm of lighting length.

FIG. 9 shows the measurement result using an input power/cm of lighting length of 280 W. In this case, for external diameters of the arc tube of 20 mm (D=20, P/D =14.0) to 28 mm (D=28. P/D=10.0), the maximum arc tube temperature was reduced to equal to or lower than 800° C., whilst maintaining the minimum arc tube temperature of 550° C. However, if the arc tube external diameter was 14 mm (D= 14, P/D=20.0) and 18 mm (D=18, P/D=15.6), the maximum arc tube temperature rose to above 800° C. Moreover, with an arc tube external diameter of 30 mm (D=30, P/D=9.3), the arc tube maximum temperature rose to above 800° C., whilst maintaining the minimum arc tube temperature at 550° C.

Figure 10:
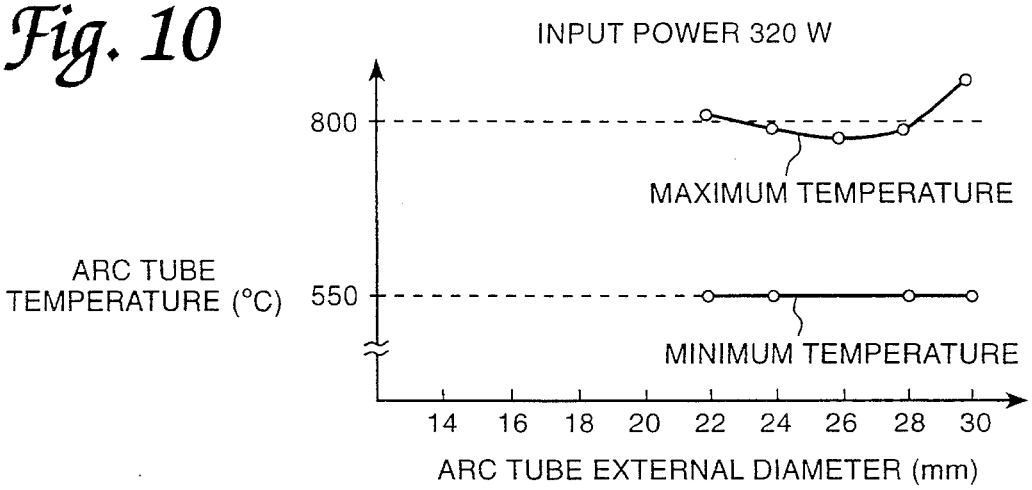
FIG. 10 A diagrammatic representation showing the relationship between an arc tube external diameter and an are tube temperature using an input power of 320 W/cm of lighting length.

FIG. 10 shows the measured result using an input power/cm of lighting length of 320 W. In this case, with arc tube external diameters of 24 mm (D=24, P/D=13.3) to 28 mm (D=28. P/D=11.4) the maximum arc tube temperature was reduced to equal to or lower than 800° C., whilst maintaining the minimum arc tube temperature at 550° C. However, if the arc tube external diameter is 14 mm (D=14, P/D= 22.9) to 22 mm (D=22, P/D=14.5), the maximum arc tube temperature rose to above 800° C. Moreover, in the case of an arc tube external diameter of 30 mm (D =30, P/D=10.7), the maximum arc tube temperature rose to above 800° C., whilst maintaining the minimum arc tube temperature of 550° C.

Figure 11:
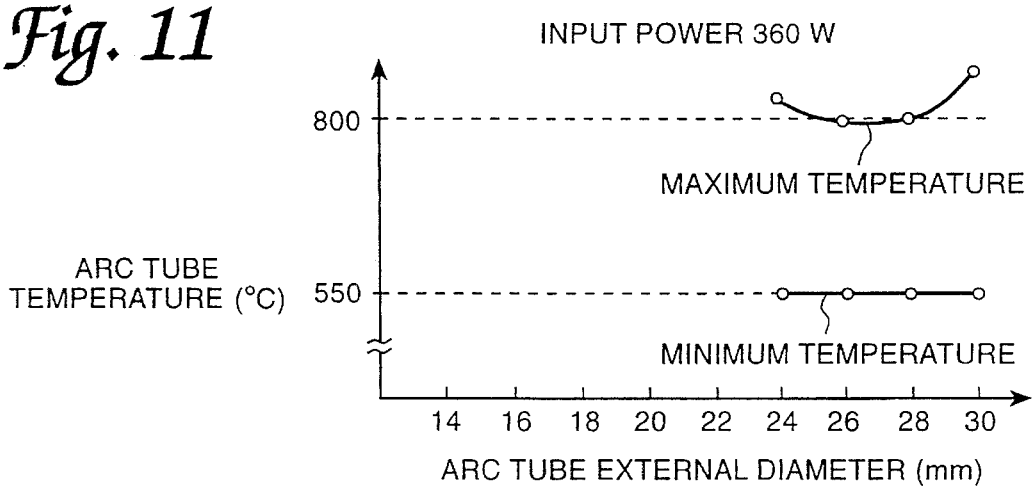
FIG. 11 A diagrammatic representation showing the relationship between an arc tube external diameter and an arc tube temperature using an input power of 360 W/cm of lighting length.

FIG. 11 shows the measured result using an input power/cm of lighting length of 360 W. In this case, with arc tube external diameters of 26 mm (D=26. P/D=13.8) and 28 mm (D=28. P/D=12.9), the maximum arc tube temperature was reduced to equal to or lower than 800° C., whilst maintaining the minimum arc tube temperature at 550° C. However, in the case of arc tube external diameters of 14 mm (D= 14, P/D=25.7) to 24 mm (D=24, P/D=15.0), the maximum arc tube temperature rose above 800° C. In addition, with an arc tube external diameter of 30 mm (D =30, P/D=12.0), the maximum arc tube temperature rose above 800° C., whilst maintaining the minimum arc tube temperature of 550° C. For an arc tube external diameter of equal to or smaller than 20 mm, the test was interrupted at a time when the maximum temperature rose above 800° C., because there was a risk of the arc tube shattering.

Figure 12:
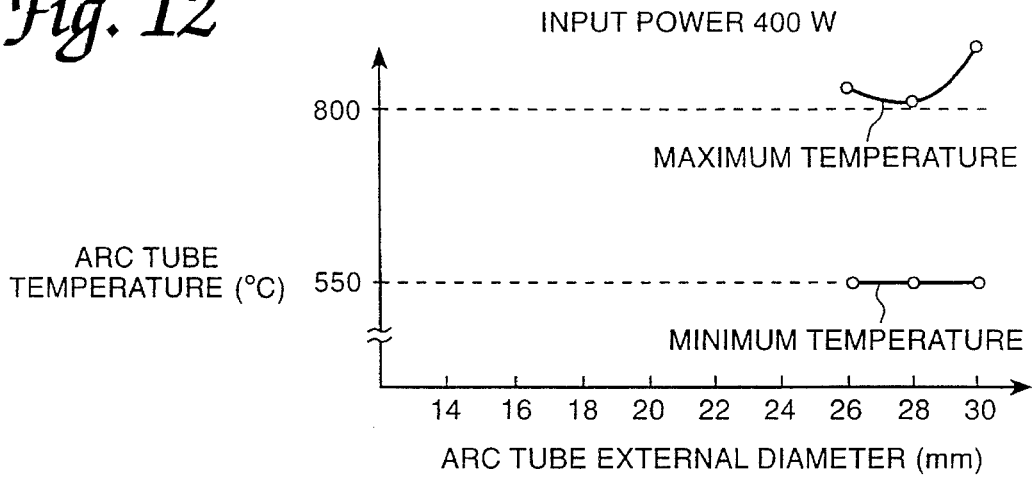
FIG. 12 A diagrammatic representation showing the relationship between an arc tube external diameter and an arc tube temperature using an input power of 400 W/cm of lighting length.

FIG. 12 shows the measurement result using an input power/cm of lighting length of 400 W. In this case it was impossible to reduce the maximum arc tube temperature to equal to or lower than 800° C. at all arc tube external diameters, whilst maintaining the arc tube minimum temperature at 550° C. However, in the case of an arc tube external diameter of 28 mm (D=28, P/D=14.3), the maximum arc tube temperature rose somewhat above 800° C. In addition, for an arc tube external diameter equal to or smaller than 24 mm, the test was broken off at the time when the maximum temperature rose above 800° C., because there was a risk of the arc tube shattering.

Thus, it was found impossible to maintain the temperature distribution range of the arc tube at equal to or greater than 550° C. and simultaneously regulate the maximum arc tube temperature to equal to or lower than 800° C., if the P/D, i.e. the relationship between an input power/cm of lighting length P (W/cm) and an external diameter of the arc tube D (mm) was not equal to or smaller than 14.

It was also found that the aforementioned regulation cannot be brought about if, independently of an input power, the arc tube external diameter is larger than 28 mm.

An advantageous (good) maintaining of the arc tube temperature can therefore be obtained if the lamp is operated using an air injection cooling system with an input power/cm of lighting length P (W/cm) higher than 160 W, provided that $D \leqq 28$ and simultaneously $P/D \leqq 14$.

Specifically, thallium and bismuth are encapsulated together with the mercury, rare gas, iron and halogen in the metallic vapour discharge lamp. A gram: atom number ratio of bismuth to thallium Bi/Tl of 1/8 to 5/1 is used. By encapsulating these metals the formation of a thin iron film can largely be prevented, whilst simultaneously obtaining a uniform, stable emission of ultraviolet rays in the arc tube axial direction.

In another embodiment it is possible to use a metallic vapour discharge lamp, in which mercury, rare gas, iron, halogen and thallium are encapsulated and in which there is a gram—atom number ratio of thallium to iron of 1/200 to 1/2. This lamp prevents the formation of a thin iron film and leads to a stable lighting operation over a long period of time.

In another embodiment it is possible to use a metallic vapour discharge lamp, in which are encapsulated mercury, rare gas, iron, halogen, magnesium and thallium and in which the thallium encapsulation quantity is $3.2\times10^{-9}$ to $2.0\times10^{-7}$ mole/cc of arc tube volume. This lamp prevents the formation of a thin iron film and simultaneously leads to an advantageous (good) lighting operation, without there being any arc displacement when operating the lamp with a consumed power lower than the rated power.

In a further embodiment it is possible to use a metallic vapour discharge lamp, in which are encapsulated mercury, rare gas, iron, halogen and bismuth and in which there is a bismuth to iron Bi/Fe ratio of 1/20 to 6/1. This lamp prevents the formation of a thin iron film and simultaneously leads to an ultraviolet radiation with an adequately uniform and stable intensity of the emission spectra of the iron in the axial direction of the tube.

EFFECT OF THE INVENTION.

In the case of the metallic vapour discharge lamp according to the invention, by using an air injection cooling system, it is possible to obtain a suitable temperature distribution range for the arc tube, even if the lighting operation is performed with a load higher than 160 W/cm of lighting length, provided the external diameter of the arc tube D is within a specific range. This means that it is possible to obtain both a desired emission and also an adequately effective prevention of the adhesion of iron to the inner wall of the arc tube. Thus, according to the invention, ultraviolet rays can be emitted in stable manner over a long time and with a high radiation intensity in a wavelength range of 250 to 400 mm.

It is to be understood that although preferred embodiments of the invention have been described, various other embodiments and variations may occur to those skilled in the art. Any such other embodiments and variations which fall within the scope and spirit of the present invention are intended to be covered by the following claim.

We claim:

1. A method of controlling a metallic vapour discharge lamp, in which mercury, a rare gas, iron, a halogen and, optionally, a metal other than mercury and iron are encapsulated within an arc tube which is surrounded, on one side, by a curved reflector mirror, comprising the steps of:

operating the lamp with an input power higher than 160 W/cm of lighting length; and cooling the lamp by injecting air through an opening in the curved reflector mirror so that it flows over and around the lamp, wherein $D \leqq 28$ and, simultaneously, $P/D \leqq 14$, D being an external diameter of the arc tube, in mm, and P being an input power per unit of lighting length in W/cm.

2. A method according to claim 1, and further comprising the step of keeping said arc tube in a temperature range of 550° C. to 800° C. while operating said lamp.

* * * * *